US005133412A

United States Patent [19]

Coronado

[11] Patent Number: 5,133,412

[45] Date of Patent: Jul. 28, 1992

[54] PULL RELEASE DEVICE WITH HYDRAULIC LOCK FOR ELECTRIC LINE SETTING TOOL

[75] Inventor: Martin P. Coronado, Houston, Tex.

[73] Assignee: Baker Hughes Incorporated, Houston, Tex.

[21] Appl. No.: 714,664

[22] Filed: Jun. 14, 1991

[51] Int. Cl.[5] ..... E21B 23/00

[52] U.S. Cl. ..... 166/381; 166/123; 166/125; 166/129

[58] Field of Search ..... 166/81, 85, 86, 88, 166/82, 187, 385, 123, 125, 208, 217, 377; 285/82, 83

[56] References Cited

U.S. PATENT DOCUMENTS

| | | | |
|---|---|---|---|
| 4,249,601 | 2/1981 | White | 166/212 X |
| 4,526,233 | 7/1985 | Stout | 166/377 |
| 4,565,247 | 1/1986 | Tapp et al. | 166/123 |
| 4,624,311 | 11/1986 | Goad | 166/125 |
| 4,756,363 | 7/1988 | Lanmon, II et al. | 166/55.1 |
| 4,880,061 | 11/1989 | Ahlstone | 166/208 |
| 4,909,321 | 3/1990 | Petree | 166/385 X |

*Primary Examiner*—Ramon S. Britts
*Assistant Examiner*—Frank S. Tsay
*Attorney, Agent, or Firm*—Melvin A. Hunn

[57] ABSTRACT

A pull release apparatus is provided for use in a wellbore when coupled between a fluid-actuated wellbore tool and a retrievable source of pressurized fluid. The pull release, fluid-actuated tool, and source of pressurized fluid are positioned in the wellbore by a positioning member, such as a wireline or a work string. A central fluid conduit is defined within the pull release device, and is adapted for receiving pressurized fluid from the source of pressurized fluid, and for directing the pressurized fluid to the fluid-actuated wellbore tool. A first latch is provided, which is operable in latched and unlatched positions. The first latch mechanically links the source of pressurized fluid to the fluid-actuated wellbore tool which unlatches the source of pressurized fluid from the fluid-actuated wellbore tool in response to axial force of a first preselected magnitude. A lock is provided which is operable in locked and unlocked positions. When in the locked position, the lock prevents the first latch from unlatching until pressurized fluid is supplied to the central fluid conduit at a preselected pressure level. A second latch is provided, and is operable in latched and unlatched positions. The second latch operates to mechanically link the source of pressurized fluid to the fluid-actuated wellbore tool. The second latch unlatches the source of pressurized fluid from the fluid-actuated wellbore tool in response to axial force of a second preselected magnitude, greater than the first preselected magnitude, which is applied through the positioning member.

13 Claims, 4 Drawing Sheets

PULL RELEASE DEVICE WITH HYDRAULIC LOCK FOR ELECTRIC LINE SETTING TOOL

BACKGROUND OF THE INVENTION

1. Field of the Invention

The present invention relates generally to disconnect devices for use in wellbore tools, and specifically to disconnect devices for use in setting tools which are suspended in a wellbore on an electric wireline, or tubular work string.

2. Description of the Prior Art

Work strings and wireline tools are frequently used to position, actuate, and operate wellbore tools, and are especially useful in positioning and actuating fluid-actuated wellbore tools, such as packers, liner hangers, and bridge plugs. However, a work string or wireline tool frequently includes subassemblies which are intended for temporary or permanent placement within the wellbore, as well as subassemblies which are intended for retrieval from the wellbore for subsequent use. For example, many inflatable packers, bridge plugs, and liner hangers are adapted for permanent placement within a wellbore. However, the tools which cooperate in the placement and actuation of such permanently-placed wellbore devices are frequently not suited for permanent placement in the wellbore. For example, sources of pressurized fluid, such as retrievable wellbore pumps, have great economic value, and are not intended for a single, irretrievable use in a wellbore. Therefore, disconnect devices exist which serve to separate a upper retrievable portion of a work string or wireline tool from a lower "delivered" portion which is intended for permanent or temporary placement in the wellbore. One such device is a hydraulically actuated disconnect for disconnecting the upper retrievable portion from the lower delivered portion. Since the hydraulic disconnect is susceptible to failure, it is prudent to provide other, alternative disconnect mechanisms. The present invention is directed to a pull release apparatus which is adapted for use in a wellbore when coupled between a fluid-actuated wellbore tool and a retrievable source of pressurized fluid. The present invention may operate alone or in combination with other disconnect devices to ensure that valuable retrievable tools are not irretrievably placed or positioned within the wellbore. This avoids the unintended loss of rather expensive and useful wireline and work string tools.

SUMMARY OF THE INVENTION

It is one objective of the present invention to provide a pull release device for use in conjunction with a setting tool which allows for mechanical decoupling of a retrievable portion of the setting tool.

It is another objective of the present invention to provide a pull release device for use in conjunction with a setting tool which allows for multiple modes of decoupling a retrievable portion of the setting tool.

It is yet another objective of the present invention to provide a pull release device which, during a running mode of operation, vents wellbore fluid from the interior of said pull release device to said wellbore to prevent inadvertent inflation of a connected inflatable packing device, or actuation of other fluid-actuated wellbore tools.

These objectives are achieved as is now described. A pull release apparatus is provided for use in a wellbore when coupled between a fluid-actuated wellbore tool and a retrievable source of pressurized fluid. The pull release, fluid-actuated tool, and source of pressurized fluid are positioned in the wellbore by a positioning means, such as a wireline or a work string. The pull release includes a number of components. A central fluid conduit is defined within the pull release device, and is adapted for receiving pressurized fluid from the source of pressurized fluid, and for directing the pressurized fluid to the fluid-actuated wellbore tool. A first latch means is provided, which is operable in latched and unlatched positions. The first latch means mechanically links the source of pressurized fluid to the fluid-actuated wellbore tool and unlatches the source of pressurized fluid from the fluid-actuated wellbore tool in response to axial force (either upward or downward, but preferably upward) of a first preselected magnitude, which is applied through the positioning means.

A lock means is provided which is operable in locked and unlocked positions. When in the locked position, the lock means prevents the first latch means from unlatching until pressurized fluid is supplied from the source of pressurized fluid to the central fluid conduit at a preselected pressure level. A second latch means is provided, and is operable in latched and unlatched positions. The second latch means operates to mechanically link the source of pressurized fluid to the fluid-actuated wellbore tool. The second latch means unlatches the source of pressurized fluid from the fluid-actuated wellbore tool in response to axial force of a second preselected magnitude, greater than the first preselected magnitude, which is also applied through the positioning means.

The pull release apparatus is operable in alternative release modes, including a first release mode, and a second release mode. In the first release mode, the lock means is placed in an unlocked position in response to pressurized fluid directed between the source of pressurized fluid to the fluid-actuated wellbore tool. Also, in the first release mode, the first latch means is moved from a latched position to an unlatched position by application of axial force of a first preselected magnitude which is applied through the first positioning means to unlatch the source of pressurized fluid from the fluid-actuated wellbore tool.

In a second release mode, the lock means is positioned in a locked position preventing the first latch means from unlatching in response to axial force of the first preselected magnitude. Therefore, the second latch means is moved from a latched to an unlatched position by application of axial force of a second preselected magnitude, which is greater than the first preselected magnitude, which is applied through the positioning means to unlatch the source of pressurized fluid from the fluid-actuated wellbore tool.

In the preferred embodiment, the pull release apparatus further includes a vent means for equalizing pressure between the fluid actuated tool and the wellbore, and a valve means operable in open and closed positions, responsive to pressurized fluid from the source of pressurized fluid, for closing the vent means.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
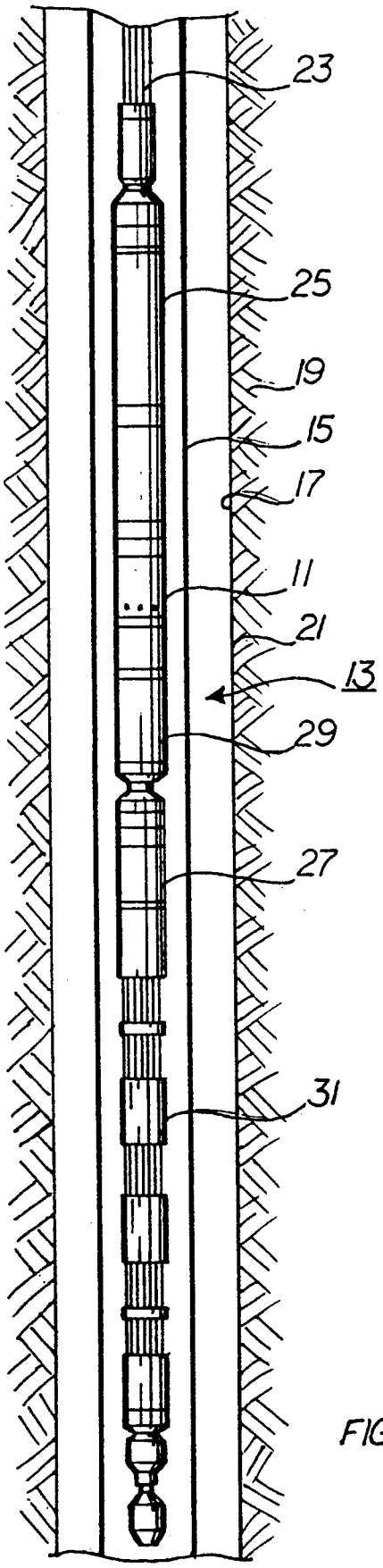
FIG. 1 is a view of the preferred pull release device of the present invention coupled in a setting tool string which includes a plurality of subassemblies, positioned within a string of tubular conduits disposed within a wellbore.

FIG. 1 is a view of the preferred pull release device 11 of the present invention, coupled in a setting tool string 13, which includes a plurality of subassemblies. The setting tool string is positioned within a string of tubular conduits 13 which is disposed within wellbore 17. Wellbore 17 extends downwardly through formation 19 and is lined by casing As shown in FIG. 1, setting tool string 13 is suspended within wellbore 17 by wireline Alternately, setting tool string 13 could be suspended within wellbore 17 by a working string. Pull release device of the present invention is especially adapted for selectively disconnecting an upper retrievable portion 25 of setting tool string 13 from a lowered delivered portion 27 of setting tool string 13. Pull release device 11 is especially adapted to serve as a back-up release device for primary release device 29. In the event primary release device 29 fails to operate properly, pull release device 11 may be actuated by alternative means to effectively separate upper retrievable portion 25 from lower delivered portion 27, allowing upper retrievable portion 25 to be raised within wellbore 17 by wireline 23 (or by a work string).

Pull release device 11 especially suited for use in setting tool strings 13 which include a lower delivered portion 27 which includes a support means 31 which operates to support lower delivered portion 27 of setting tool string 13 within wellbore 17 independently of wireline 23 (or similar suspension means such as a working string).

The preferred embodiment of pull release device 11 of the present invention operates in a number of modes to take into account a variety of wellbore problems and conditions. In a running mode of operation, pull release device 11 prevents unintended actuation of lower delivered portion 27 of setting tool string 13. Also, in a running mode of operation, pull release device 11 operates to prevent the unintended disconnection of upper retrievable portion 25 from lower delivered portion 27 of setting tool string 13. In a setting mode of operation, pull release device 11 operates to allow actuation of lowered deliver portion 27 of setting tool string 13 upper retrievable portion 25.

In a first release mode of operation, pull release device 11 operates to disconnect upper retrievable portion 25 of setting tool string 13 from lower delivered portion 27 in the event primary release device 29 fails to operate properly. In a second (emergency) release mode of operation, pull release device 11 operates to disconnect upper retrievable portion 25 of setting tool string 13 from lower delivered portion 27 in the event that setting tool string becomes stuck in wellbore 17, or more particularly, if setting tool string 13 becomes stuck in string of tubular conduits 15.

The pull release device 11 the present invention is especially adapted for use when setting tool string 13 is raised and lowered within wellbore 17 through the central bore of string of tubular conduits 15. In such through-tubing applications, clearances are tight and the risk of becoming stuck are great.

Figure 2:
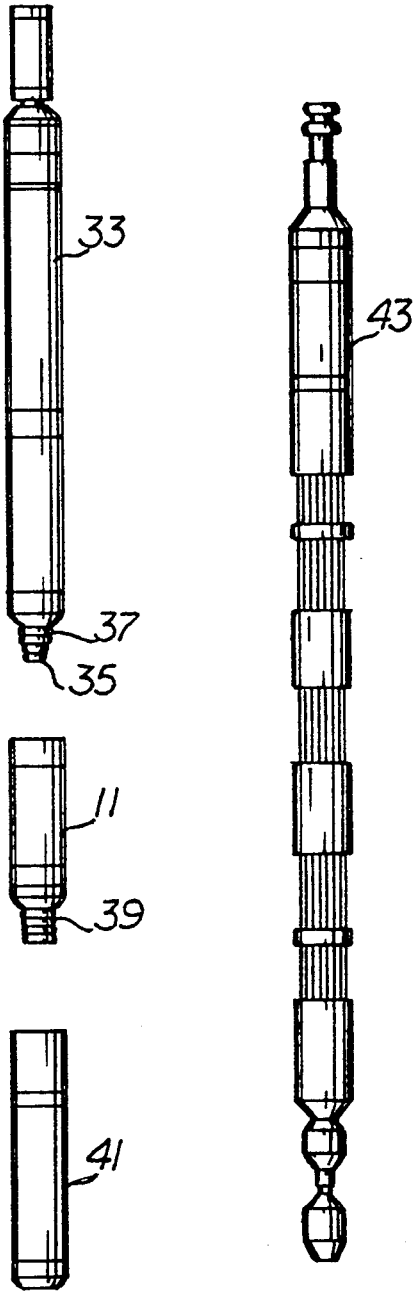
FIG. 2 is an exploded view of the setting tool string of FIG. 1; this figure facilitates discussion of the subassemblies which make up the setting tool string.

The components and subassemblies which make-up setting tool string 13 of FIG. 1 will be more fully described in connection with FIG. 2, which is an exploded view of setting tool string 13 of FIG. 1. The view of FIG. 2 facilitates discussion of the subassemblies which make-up setting tool string 13. In one preferred use of pull release device 11 upper retrievable portion 25 of setting tool string 13 comprises a through-tubing wellbore pump 33 (which receives wellbore fluid from wellbore 17 and produces a higher pressure wellbore fluid which exits lower end 35 of through-tubing wellbore pump 33 which is externally threaded at external threads 37 for coupling to pull release device 11). Preferably, pull release device 11 is externally threaded at external threads 39 for coupling to primary release device 29, which preferably comprises hydraulic disconnect running tool 41. Hydraulic disconnect running tool 41 is, in turn, releasably coupled to lower delivered portion 27 of setting tool string 13 which preferably comprises bridge plug 43.

In this preferred application, through-tubing wellbore pump 33, hydraulic disconnect running tool 41, and bridge plug 43 are items which are commercially available tools manufactured by Baker Hughes Incorporated. Through-tubing wellbore pump 33 comprises an electric wireline setting tool, identified by Model No. 437-14-0002. Hydraulic disconnect running tool 41 comprises a hydraulic disconnect running tool identified by Model No. 330-72-2101. Bridge plug 43 comprises a bridge plug identified by Model No. 340-01-3386. However, it should be appreciated that pull release device 11 the present invention is not restricted for use with these particular wellbore devices, and is equally suitable for use with other wellbore tools, including those manufactured by Baker Hughes Incorporated, and others. Setting tool string 13 of FIGS. 1 and 2 is merely one configuration in which pull release device 11 can be used.

As is well known by one skilled in the art, bridge plug 43 is adapted for receiving pressurized wellbore fluid from a source of pressurized fluid, and includes valving which directs pressurized fluid into an inflation chamber which outwardly radially expands flexible elements which serve to grippingly and sealingly engage a wellbore surface, such as string of tubular conduits 15 or casing 21. Therefore, bridge plug 43 is adapted to support itself within wellbore 17 without the assistance of wireline 23 or other suspension means.

Once bridge plug 43 is fixedly positioned within wellbore 17, the remaining principal concern is that the expensive through-tubing wellbore pump 33 be retrieved from wellbore 17 by wireline 23 or similar suspension means. Pull release device 11 and hydraulic disconnect running tool 41 together provide multiple modes of release operation, to ensure that through-tubing wellbore pump 33 is indeed separated or disconnected from bridge plug 43. Should both pull release device 11 and hydraulic disconnect running tool 41 fail to release, through-tubing wellbore pump 33 may be irretrievably positioned within wellbore 17, at significant expense, since such specialized wellbore pumps frequently cost tens of thousands of dollars.

Figure 3:
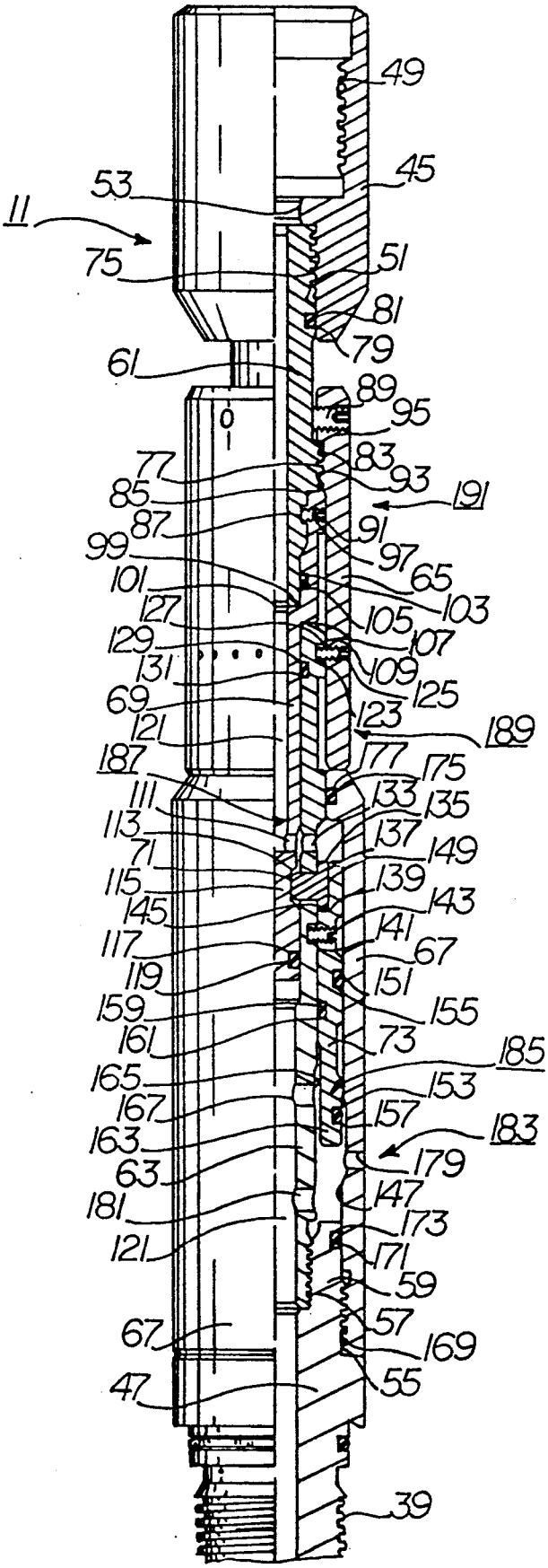
FIG. 3 is a one-quarter longitudinal section view of the preferred embodiment of the pull release device of the present invention.

FIG. 3 is a one-quarter longitudinal section view of the preferred embodiment of pull release device 11 the present invention. Pull release device 11 includes upper cylindrical collar 45 for mating with external threads 37 (of FIG. 2) of through-tubing wellbore pump (of FIG. 2), and lower cylindrical collar 47 with external threads 39 for mating with hydraulic disconnect running tool 41 (of FIG. 2).

Upper cylindrical collar 45 includes upper internal threads 49 and lower internal threads 51. Upper internal threads 49 mate with external threads 37 of through-tubing wellbore pump 33 Internal shoulder is disposed between lower internal threads 51 and upper internal threads 49. Lower cylindrical collar 47 further includes external threads 55 and internal threads 57 disposed on opposite sides of shoulder 59.

The components which make-up pull release device 11 are disposed between upper cylindrical collar 45 and lower cylindrical collar 47. Seven principal components cooperate together in the preferred embodiment of pull release device 11 the present invention, including: upper inner mandrel 61, lower inner mandrel 63, upper outer body piece 65, lower outer body piece 67, lock piece 69, locking key 71, and hydraulically-actuated slidable sleeve 73. With the exception of locking key 71, these principal components are cylindrical-shaped sleeves which are interconnected by threaded couplings, shearable connectors, set screws, shoulders, and seals, all of which will be described in detail below.

As shown in FIG. 3, upper inner mandrel 61, and lower inner mandrel 63 are disposed radially inward from upper outer body piece and lower outer body piece 67. Lock piece 69 is at least in-part disposed between upper and lower inner mandrels 61, 63 and upper and lower outer body pieces 65, 67. Lock piece 69 is adapted for selectively engaging locking key 71. Locking key 71 is held in position by hydraulically-actuated slidable sleeve 73 until pressurized wellbore fluid causes hydraulically-actuated slidable sleeve 73 to move downward relative to lower inner mandrel 63 and lower outer body piece 67.

Upper inner mandrel includes external threads 75, 77 which are located at its upper end and midregion respectively. External threads 75 serve to mate with internal threads of upper cylindrical collar 45. External threads 77 serve to mate with internal threads 93 of upper outer body piece 65. The exterior surface of upper inner mandrel is also equipped with seal cavity 79 which retains O-ring seal 81 at an interface with upper cylindrical collar 45.

The outer surface of upper inner mandrel 61 is also equipped with external shoulder 83 and internal shoulder 85. External shoulder 83 is adapted for mating with internal shoulder 95 of upper outer body piece 65 above the threaded coupling of external threads 77 and internal threads 93.

Set screw 89 extends through, and is threadingly engaged with, the upper end of upper outer body piece 65 directly above the threaded coupling of external threads 77 and internal threads 93. Set screw 89 abuts the outer surface of upper inner mandrel 61. Shear connector cavity 87 is disposed directly below internal shoulder 85 of upper inner mandrel 61, and is adapted to receive a shearable connector 91 which is carried by connector cavity 97 which extends through the upper end of lock piece 69. Shearable connector 91 engages lock piece 69, and secures it to upper inner mandrel 61.

Accordingly, an upper portion of lock piece 69 is disposed between upper inner mandrel 61 and upper outer body piece 65. Lock piece 69 further includes internal shoulder 99 which receives lower end of upper inner mandrel 61. Lock piece 69 further includes seal cavity 103 which retains O-ring seal 105 in sealing engagement with the outer surface of the lower end 101 of upper inner mandrel 61. Internal shoulder 107 is disposed on the outer surface of lock piece 69 in a position slightly below internal shoulder 99 which is disposed on the interior surface of lock piece 69. Internal shoulder 107 is adapted to receive the upper end 109 of lower inner mandrel 63.

Lock piece 69 terminates at its lower end in plug 115, which is enlarged to obstruct the flow of fluid directly downward through pull release device 11. Plug 115 has an exterior surface which mates with the interior surface of lower inner mandrel 63, and is sealed by O-ring 119 which is carried in seal cavity 117.

Bypass port 111 is disposed directly above plug 115, and is adapted for receiving fluid which is directed downward through central fluid conduit 121 and directing it radially outward through lock piece 69. Lock piece 69 further includes lock groove 113 which is adapted to receive locking key 71.

Lower inner mandrel 63 is disposed in-part at its upper end between lock piece 69 radially inward and upper and lower outer body pieces 65, 67 radially outward. Lower inner mandrel 63 includes shear connector cavity 123 which is disposed on its outer surface at its upper end, which is adapted for receiving shearable connector 125 which mates in connector cavity 127 which extends radially through upper outer body piece 65 and releasably couples upper outer body piece 65 to lower inner mandrel 63. Seal cavity 129 is disposed on the inner surface of lower inner mandrel 63, radially inward from shear connector cavity 123. Seal cavity 129 is adapted for receiving O-ring seal 131, and sealingly engaging the outer surface of lock piece 69.

Lower inner mandrel 63 also includes bypass port 133 which is in alignment with bypass port 111 of lock piece 69. Lower inner mandrel 63 further includes key cavity 135. Locking key 71 extends radially inward through key cavity 135 to seat in lock groove of lock piece 69. Locking key 71 includes stops 137, 139, which prevent locking key 71 from passing completely through key cavity 135.

Lower inner mandrel 63 further includes shearable connector cavity 141 which is adapted for receiving shearable connector 143 which extends through connector cavity 145 to couple hydraulically-actuated shearable sleeve 73 to lower inner mandrel in a fixed position between lower inner mandrel 63 and lower outer body piece 67. Hydraulically actuated slidable sleeve 73 resides within bypass cavity 147 which is a space defined by lower inner mandrel 63 and lower outer body piece 67. At its upper end, hydraulically-actuated slidable sleeve 73 includes key retaining segment 149 which is adapted to fit between locking key 71 and lower outer body piece 67, to hold locking key 71 in place.

Hydraulically-actuated slidable sleeve 73 further includes upper and lower O-ring seals 151, 153 on its exterior surface, in upper and lower seal chambers 155, 157. O-ring seal 159 is carried on the inner surface of hydraulically-actuated slidable sleeve 73 in seal chamber 161. The interfacing inner surface of hydraulically-actuated slidable sleeve 73 and outer surface of lower inner mandrel 63 are undercut at undercut regions 163, 165, respectively, ensuring that O-ring seal 159 is not in a sealing engagement with the exterior surface of lower inner mandrel 63 when hydraulically-actuated slidable sleeve 73 is urged downward within bypass cavity 147 in response to the passage of high pressure wellbore fluid through central fluid conduit bypass port and bypass port 113.

Accordingly, high pressure wellbore fluid will flow between the inner surface of hydraulically-actuated slidable sleeve 73 and the outer surface of lower inner mandrel 63. The high pressure fluid will reenter central fluid conduit 121 through conduit port 167, which serves to communicate fluid between bypass cavity 147 and central fluid conduit when hydraulically-actuated slidable sleeve 73 is moved downward.

Lower outer body piece 67 is connected to external threads 65 of lower cylindrical collar 47 by internal threads Lower cylindrical collar 47 sealingly engages lower outer body piece 67 at O-ring seal 171 which is carried in seal chamber 173 on the outer surface of lower cylindrical collar 47. At its upper end, lower outer body piece 67 includes O-ring seal 175 which is carried in seal chamber 177 which is disposed on the interior surface of lower outer body piece 67 and sealingly engages lower inner mandrel 63.

Lower outer body piece 67 abuts the lower end of upper outer body piece 65. Together, upper and lower outer body pieces 65, 67 serve to provide an outer protective housing for pull release device Lower outer body piece 67 is further equipped with pressure equalization port 179 which serves to communicate fluid between bypass cavity 147 and the exterior of pull release device 11. When pull release device 11 is disposed in a wellbore, pressure equalization port 179 serves to communicate wellbore fluid between wellbore 17 and bypass cavity 147. A similar pressure equalization port 181 is provided in lower inner mandrel 63, in approximate alignment with pressure equalization port 179. Pressure equalization port 181 serves to communicate wellbore fluid between bypass cavity 147 and central fluid conduit 121. Wellbore fluid may only be communicated between wellbore 17 and central fluid conduit 121 when hydraulically-actuated slidable sleeve 73 is in its upward position. When hydraulically-actuated slidable sleeve 73 is urged downward by pressurized wellbore fluid, upper and lower O-ring seals 151, 153 serve to straddle pressure equalization port 179 and prevent the passage of wellbore fluid between wellbore 17 and central fluid conduit 121.

Pull release device 11 of FIG. 3 will now be described in more general, functional terms. For purposes of exposition, it can be considered that a fluid conduit is defined by central fluid conduit 121, bypass port 111, bypass port 133, bypass cavity 147, and conduit port 167. This fluid conduit serves to receive pressurized wellbore fluid from a source of pressurized wellbore fluid, and direct the pressurized wellbore fluid to a fluid-actuated wellbore tool, such as an inflatable packing device.

Further, it can be considered that pressure equalization port 179, bypass cavity 147, and pressure equalization port 181 cooperate to equalize pressure between the central fluid conduit during a running mode when hydraulically-actuated slidable sleeve 73 is in an upward position.

Hydraulically-actuated slidable sleeve 73 can be considered as a valve means 185, operable in open and closed positions, which is responsive to pressurized wellbore fluid from a source of pressurized fluid, for closing a vent means 183 to prevent communication of wellbore fluid from a central fluid conduit to wellbore 17.

Shearable connector 125, connector cavity 127, and shear connector cavity 123, which couple upper outer body piece 65 to lock piece 69, can be considered as a first latch means 189, operable in latched and unlatched positions, for mechanically linking a source of pressurized fluid to a fluid-actuated wellbore tool. First latch means 189 unlatches the source of pressurized fluid from the fluid-actuated wellbore tool in response to axial force, of a first preselected magnitude, applied through wireline 23 or similar suspension means. This is true because shearable connector 125 is adapted to shear loose at a preselected axial force level. In the preferred embodiment, a plurality of shearable connectors are disposed between upper outer body piece 65 and lock piece 69. The magnitude of the upward force required to shear shearable connector 125 may be determined in advance by selection of the number, cross-sectional area, and material of shearable connector 125, and similar connectors.

Likewise, shearable connector 91, and cooperating shear connector cavity 87, and connected lock piece 69 and upper inner mandrel 61 can be considered a second latch means 191 which is operable in latched and unlatched positions, for mechanically linking a source of pressurized fluid to a fluid-actuated wellbore tool. Second latch means 191 unlatches the source of pressurized fluid from the fluid actuated wellbore tool in response to axial (upward) force, of a second preselected magnitude greater than the first preselected magnitude, which is applied through wireline 23 or similar suspension means. Once again, shearable connector 91 may comprise a plurality of radially disposed shearable connectors of selected number, cross-sectional area, and material, to set the level of the upward force of second preselected magnitude.

Lock piece 69, locking key 71, and related lock groove 113, and key cavity 135, as well as key retaining segment 149 of hydraulically-actuated slidable sleeve 73 can be considered as a lock means 87 which is operable in locked and unlocked positions, for preventing, when in the locked position, the first latch means from unlatching until pressurized fluid is supplied from a source of pressurized fluid to the central fluid conduit at a preselected pressure level.

Fluid-actuated slidable sleeve 73 may be considered a valve means 185. When the preselected pressure level is obtained, shearable connector 143 shears, and fluid-actuated slidable sleeve 73 is urged downward in bypass cavity 147 to close vent means 183 and allow passage of wellbore fluid around plug 115, through bypass cavity 147, and to simultaneously prevent the passage of pressurized wellbore fluid outward into wellbore 17 through pressure equalization port 179.

The different operating modes of pull release device 11 of the present invention are more clearly set forth in FIGS. 4 through 7, which are partial longitudinal section views of the preferred pull release device 11 the present invention in a plurality of modes including: a running mode, a setting mode, an ordinary pull release mode, and an emergency pull release mode.

Figure 4:
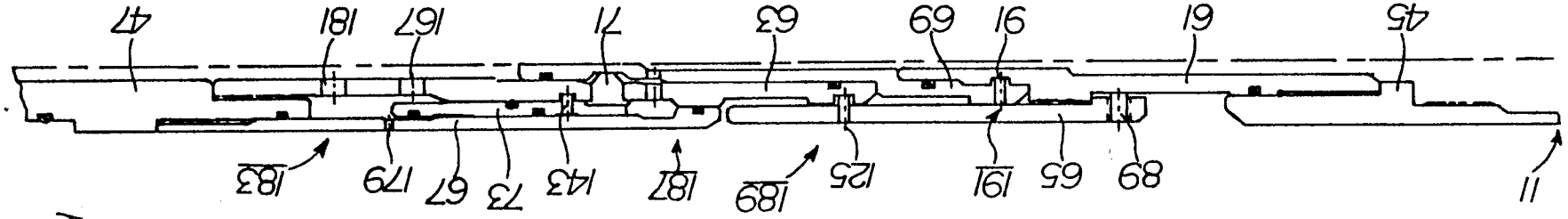
FIG. 4 is a partial longitudinal section view of the preferred pull release device of the present invention in a running mode of operation during run-in into the wellbore.

FIG. 4 is a partial longitudinal section view of the preferred pull release device 11 the present invention in a running mode of operation during run-in into wellbore 17. As shown in this figure, upper cylindrical collar 45 is positioned to the left in the figure, and lower cylindrical collar 47 is positioned to the right in the figure. As shown, upper cylindrical collar 45 is coupled by threads to upper inner mandrel 61. Upper outer body piece 65 is coupled by set screw 89 to upper inner mandrel 61. For purposes of exposition, set screw 89 is represented by a dashed line. Upper outer body piece 65 is coupled to lower inner mandrel 63 by first latch means 189. For purposes of exposition, first latch means 189 includes shearable connector 125 which is represented by a dashed line. Upper inner mandrel 61 is connected to lock piece 69 at second latch means 191. Second latch means 191 includes shearable connector 91 which is represented by a dashed line.

Lower inner mandrel 63 and lock piece 69 are held together by locking key 71. Locking key 71 is held in place by hydraulically-actuated slidable sleeve 73. Hydraulically-actuated slidable sleeve 73 is held in place relative to lower inner mandrel 63 by shearable connector 143, which is represented by a dashed line. Pull release device 11 further includes conduit port 167, and pressure equalization ports 179, 181, which cooperate together to equalize pressure within pull release device 11 and fluid actuated tool below.

During a running mode of operation, pull release device 11 of the present invention accomplishes two objectives. First, locking key 71 is mechanically in parallel with first latch means 189, and serves to prevent inadvertent opening of first latch means 189 by accidental shearing of shearable connector 125. Second, vent means 183, which includes the coordinated operation of conduit port 167, and pressure equalization ports 179, 181 serves to prevent gas which is trapped within pull release device 11om accidentally actuating the fluid-actuated tool or tools which ar carried in the string.

Each of these two problems deserve additional consideration. In the preferred embodiment, pull release device 11 of the present invention is carried in a string of subassemblies, as shown in FIGS. 1 and 2, and described above. The string is raised and lowered within wellbore 17 by either a wireline 23 or a work string of tubular conduits. As the setting tool string 13 is raised and lowered within the wellbore, it is possible that axial force will be applied to pull release device 11 in an amount which exceeds the force threshold for shearable connector 125 (or the plurality of connectors like shearable connector 125).

In the preferred embodiment, first latch means 189 is switched between latched and unlatched positions by application of an upward force in an amount which exceeds a first preselected force magnitude. As discussed above, the force is established by selection of one of more shearable connectors 125 which are severed in the preferred embodiment by applying an upward force on pull release device 11. However, in alternative embodiments, it is possible to have a first latch means 189 which is moved between latched and unlatched positions by application of a downward force in excess of a preselected force limit magnitude.

In the preferred embodiment, this force magnitude may be set in the range of eighteen hundred pounds of force. Preferably, lock means 187 (which includes locking key 71 which releasably mates with lock piece 69 through lower inner mandrel 63) is adapted to withstand forces in excess of eighteen hundred pounds of force. Therefore, lock means 187 operates to prevent the inadvertent shearing of shearable connector 125 as setting tool string 13 is raised and lowered within wellbore 17.

The vent means 183 is particularly useful to prevent the inadvertent actuation of hydraulically-actuated wellbore tools. The inadvertent actuation of wellbore tools, such as packers, liner hangers, and bridge plugs, is most acute when setting tool string 13 is raised within wellbore 17. Natural gas may become trapped within setting tool string 13 at a deep, high-pressure environment. When setting tool string 13 is raised within wellbore 17 to a shallower, lower-pressure environment, the natural gas trapped within setting tool string 13 may expand, and inadvertently actuate fluid-actuated tools.

This is a particular problem in through-tubing applications where the clearance between setting tool string 13 and string of tubular conduits 15 (see FIG. 1) is quite tight. Setting tool string 13 may be raised within wellbore 17 for a number of reasons, including an inability to position setting tool string 13 at a desired location within wellbore 17. If a packer or bridge plug inadvertently inflates and sets against string of tubular conduits 15 as setting tool string is raised within wellbore 17, this could present very serious problems, requiring that a special tool be lowered within the well to puncture the packer or bridge plug to allow setting tool string 13 to be removed from wellbore 17.

Figure 5:
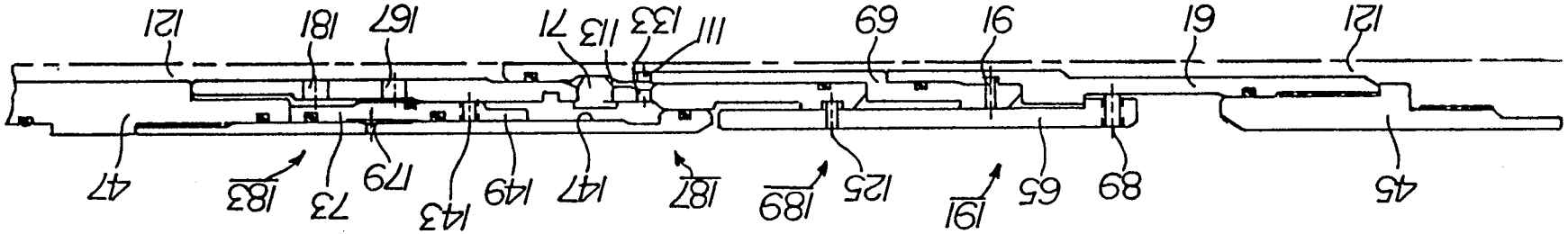
FIG. 5 is a partial longitudinal section view of the preferred pull release device of the present invention in a setting mode of operation.

FIG. 5 is a partial longitudinal section view of the preferred pull release device 11 the present invention in a setting mode of operation. During this mode of operation, high pressure wellbore fluid is directed downward through pull release device 11. Specifically, pressurized fluid is directed downward through central fluid conduit 121, then through bypass ports 111, 133, into bypass cavity 147. The high pressure wellbore fluid exerts downward force on hydraulically-actuated shearable sleeve 73, causing shearable connector 143 to shear. (In the preferred embodiment, hydraulically-actuated sleeve moves downward at 1,500 p.s.i. of pressure,. as determined by the size and strength of shearable connector 143). As a result, hydraulically-actuated slidable sleeve 73 is urged downward within bypass cavity 147. In the closed position the "vent means" 183 which is defined by these components switches from an open to a closed position with hydraulically-actuated slidable sleeve 73 closing off the communication of wellbore fluid through conduit port 167, and pressure equalization ports 171, 181. Also, high pressure fluid is diverted through bypass cavity 147 across the interface of hydraulically-actuated slidable sleeve 73 and lower inner mandrel 63. The high pressure fluid will be shunted back into central fluid conduit 121 by conduit port 167, and pressure equalization port 181.

Another consequence of the downward movement of hydraulically-actuated slidable sleeve 73 is that key retaining segment 149 of fluid-actuated slidable sleeve 73 is no longer maintaining locking key 71 in locking groove 113. Consequently, first latch means 189 can be moved between latched and unlatched positions by application of axial force of the preselected magnitude.

Figure 6:
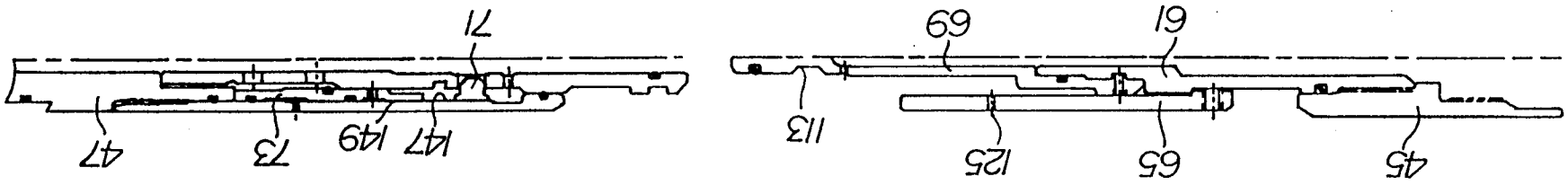
FIG. 6 is a partial longitudinal section view of the preferred pull release device of the present invention in an ordinary pull release mode of operation.

FIG. 6 is a partial longitudinal section view of the preferred pull release device 11 the present invention in an ordinary pull release mode of operation. As discussed above, pull release device 11 is especially useful to supplement a primary release device within setting tool string 13. Usually, primary release device 29 is a fluid-actuated device. Should primary release device 29 fail to operate properly, pull release device 11 of the present invention allows for release of an upper retrievable portion 25 of setting tool string 13 from a lower delivered portion 27, by mechanical means.

The high pressure wellbore fluid which is directed downward through pull release device 11 serves to set lowered delivered portion 27 in a fixed position within wellbore 17. As a consequence of this setting, hydraulically-actuated slidable sleeve 73 is urged downward within bypass cavity 147. Consequently, key retaining segment 149 of hydraulically-actuated slidable sleeve 73 no longer maintains locking key 71 in a locked position within lock groove 113 of lock piece 69. Consequently, locking key 71 will move radially outward, and allowable shearable connector 125 to be sheared by application of axial force to pull release device 11. As stated above, preferably shearable connector 125 sets a known axial force limit, such as eighteen hundred pounds of force, which can be selectively applied to setting tool string 13 by wireline 23 or similar suspension means.

Figure 7:
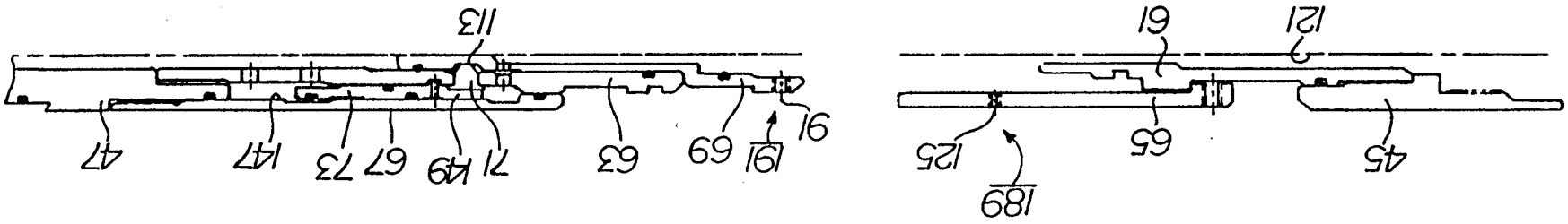
FIG. 7 is a partial longitudinal section view of the preferred pull release device of the present invention in an emergency pull release mode of operation.

FIG. 7 is a partial longitudinal section view of the preferred pull release device 11 the present invention in an emergency pull release mode of operation. This emergency pull release mode of operation is responsive to a situation which arises from the failure of hydraulically-actuated slidable sleeve 73 to slide downward within bypass cavity 147 in response to high pressure fluid which is directed downward through central fluid conduit 121. When this occurs, lock piece 69 if fixed in position relative to lower cylindrical collar 47, and cannot be removed from the wellbore. In this event, a greater axial force (preferably an upward axial force applied through wireline 23 or similar suspension means) is applied to the setting tool string 13, causing shearable connector 125 and shearable connector 91 to shear.

In the preferred embodiment, shearable connector 91 is set to shear at approximately four thousand pounds of axial force. Therefore, in the preferred embodiment, second latch means 191 will move between open and closed positions simultaneous with first latch means 189, when approximately fifty-eight hundred pounds of axial force is applied to pull release device 11. The emergency release mode of operation shown in FIG. 7 is particularly useful when setting tool string 13 becomes lodged in an undesired position during the running in or running out of the tool.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A pull release apparatus adapted for use in a wellbore when coupled between an inflatable packing device, of the type which expands radially outward to engage a wellbore surface in response to pressure from a wellbore fluid, and a source of pressurized wellbore fluid, said pull release, inflatable packing device, and source of pressurized wellbore fluid suspended in said wellbore by a suspension means, comprising:

a central fluid conduit for receiving pressurized wellbore fluid from said source of pressurized wellbore fluid and directing to said pressurized wellbore fluid to said inflatable packing device;

a vent means for communicating wellbore fluid between said central fluid conduit and said wellbore;

a valve means, operable in an open and closed position, responsive to pressurized wellbore fluid from said source of pressurized fluid, for closing said vent means to prevent communication of wellbore fluid from said central fluid conduit to said wellbore;

a latch means, operable in latched and unlatched positions, for mechanically linking said source of pressurized wellbore fluid to said inflatable packing device, which unlatches said inflatable packing device from said source of pressurized fluid in response to axial force of a first preselected magnitude, applied through said suspension means;

a lock means, operable in locked and unlocked positions, for preventing, when in said locked position, said latch means from unlatching until pressurized wellbore fluid is supplied from said source of pressurized wellbore fluid to said central fluid conduit at said first preselected pressure level;

wherein said pull release apparatus is operable in a plurality of operating modes, including:

a running mode, wherein said valve means is in an open position to allow communication of wellbore fluid through said vent means to prevent inadvertent inflation of said inflatable packing device, and wherein said lock means is in a locked position to prevent inadvertent unlatching of said source of pressurized wellbore fluid from said inflatable packing device; and a setting mode, wherein said valve means is in a closed position to prevent communication of wellbore fluid through said vent means and allowing inflation of said inflatable packing device, and wherein said lock means is in an unlocked position to allow unlatching of said source of pressurized wellbore fluid from said inflatable packing device once inflation is completed.

2. A pull release apparatus according to claim 1, further comprising:

an emergency latch means, operable independently of said source of pressurized wellbore fluid in latched and unlatched positions, for mechanically linking said source of pressurized fluid to said inflatable packing device, which unlatches said inflatable packing device from said source of pressurized fluid in response to axial force, of a second preselected magnitude greater than said first preselected magnitude, applied through said suspension means.

3. A pull release apparatus according to claim 1, wherein said valve means obstructs said central fluid conduit preventing passage of wellbore fluid from said source of pressure to said inflatable packing device, wherein pressurized wellbore fluid from said source of pressure simultaneously closes said vent means and unobstructs said central fluid conduit.

4. A pull release apparatus according to claim 1, wherein said vent means comprises a port extending between said central fluid conduit and said wellbore, and wherein said valve means comprises a slidable sleeve secured in position relative to said pull release apparatus by a shearable connector, wherein application of pressurized wellbore fluid from said source of pressurized wellbore fluid to said slidable sleeve causes said shearable connector to shear and said slidable sleeve to slide into a position which obstructs said port.

5. A pull release apparatus according to claim 1, wherein said lock means remains in said locked position until said valve means is in a closed position.

6. A pull release apparatus according to claim 1, wherein said lock means comprises a locking key which operates in parallel with said latch means to prevent unlatching of said source of pressurized wellbore fluid from said inflatable packing device, but which moves between locked and unlocked positions as said valve means is moved between open and closed positions.

7. A pull release apparatus adapted for use in a wellbore when coupled between a fluid-actuated wellbore tool and a retrievable source of pressurized fluid, said pull release, fluid-actuated tool, and source of pressurized fluid being positioned in said wellbore by a positioning means, comprising:

a central fluid conduit for receiving pressurized fluid from said source of pressurized fluid and directing said pressurized fluid to said fluid-actuated wellbore tool;

a first latch means, operable in latched and unlatched positions, for mechanically linking said source of pressurized fluid to said fluid-actuated wellbore tool which unlatches said source of pressurized fluid from said fluid-actuated wellbore tool in response to axial force, of a first preselected magnitude, applied through said positioning means;

a lock means, operable in locked and unlocked positions, for preventing, when in said locked position, said first latch means from unlatching until pressurized fluid is supplied from said source of pressurized fluid to said central fluid conduit at said first preselected pressure level;

a second latch means, operable in latched and unlatched positions, for mechanically linking said source of pressurized fluid to said fluid-actuated wellbore tool, which unlatches said source of pressurized fluid from said fluid-actuated wellbore tool in response to axial force, of a second preselected magnitude greater than said first preselected magnitude, applied through said positioning means;

wherein said pull release apparatus is operable in alternative release modes, including:

a first release mode, wherein said lock means is placed in an unlocked position in response to pressurized fluid directed between said source of pressurized fluid to said fluid-actuated wellbore tool, and said first latch means is moved from a latched to an unlatched position by application of axial force of a first preselected magnitude which is applied through said positioning means to unlatch said source of pressurized fluid from said fluid-actuated wellbore tool; and a second release mode, wherein said lock means is placed in a locked position preventing said first latch means from unlatching in response to axial force of said first preselected magnitude, and said second latch means is moved from a latched to an unlatched position by application of axial force of said second preselected magnitude which is applied through said positioning means to unlatch said source of pressurized fluid from said fluid-actuated wellbore fluid.

8. A pull release apparatus according to claim 7, further comprising:

a vent means for equalizing pressure between said central fluid conduit and said wellbore; and a valve means, operable in open and closed positions, responsive to pressurized fluid from said source of pressurized fluid, for closing said vent means.

9. A pull release apparatus according to claim 7, wherein said lock means comprises a locking dog which operates in combination with said first latch means to prevent unlatching of said source of pressurized wellbore fluid from said fluid-actuated wellbore tool.

10. A pull release apparatus according to claim 7, wherein said pull release apparatus is operable in a plurality of modes, including:

a running mode, wherein said first latch means is maintained in a latched position by operation of said lock means in a locked position, to prevent inadvertent unlatching of said source of pressurized fluid from said fluid-actuated wellbore tool through inadvertent application of axial force in an amount at or above said first preselected magnitude through said positioning means; and a setting mode, wherein said lock means is moved from a locked position to an unlocked position, to allow said first latch means to be moved from a latched position to an unlatched position by application of axial force in an amount at or above said first preselected magnitude through said positioning means to separate said source of pressurized fluid from said fluid-actuated wellbore tool.

11. A method of placing a fluid-actuated wellbore ,tool in a wellbore with a support member, comprising the steps of:

(a) providing a retrievable source of pressurized fluid;

(b) providing a pull release device, including a central fluid conduit for receiving pressurized fluid from said source of pressurized fluid, a latch member operable in latched and unlatched positions which moves between latched and unlatched positions in response to axial force of at least a first preselected release magnitude applied to said pull release device, and a lock member operable in locked and unlocked positions which prevents said latch member from unlatching until pressurized fluid is supplied to said pull release device at said first preselected pressure level;

(c) coupling said fluid-actuated wellbore tool, said source of pressurized fluid, and said pull release device together in a string, with said source of pressurized fluid disposed at the top of said string and said fluid-actuated wellbore tool disposed at the bottom of said string, with said pull release device disposed between said source of pressurized fluid and said fluid-actuated wellbore too;

(d) lowering said string within said wellbore with said support member;

(e) directing pressurized fluid from said source of pressurized fluid to said fluid-actuated wellbore tool through said central fluid conduit, causing said lock member to move from a locked to an unlocked position;

(f) actuating said fluid-actuated wellbore tool with said pressurized fluid from said source of pressurized fluid;

(g) applying axial force of at least said first preselected release magnitude to said pull release device through said support member, causing said source of pressurized fluid to separate from said string; and (h) retrieving said source of pressurized fluid from said wellbore with said support member and leaving said fluid actuated wellbore tool within said wellbore.

12. A method of placing a fluid-actuated wellbore tool in a wellbore, according to claim 11, wherein said pull release device further includes a second latch member operable in latched and unlatched position which moves between latched and unlatched position in response to axial force of at least a second preselected release magnitude which exceeds said first preselected release magnitude, further comprising applying axial force of at least said second preselected release magnitude to said pull release device through said support member, in the event said lock member fails to move between locked and unlocked positions in response to pressurized fluid, to separate said source of pressurized fluid from said string.

13. A method of placing a fluid actuated wellbore tool in a wellbore, according to claim 11, wherein said pull release device includes a vent member for equalizing pressure within said central fluid conduit with said wellbore, and a valve member for opening and closing said vent member, further comprising the steps of:

(a) maintaining said vent member in an open position during said lowering to equalize pressure within said central fluid conduit with said wellbore to prevent unintended actuation of said fluid-actuated wellbore tool; and (b) moving said valve member between opened and closed positions to close said vent member concurrent with the step of directing pressurized fluid from said source of pressurized fluid to said fluid-actuated wellbore tool.

* * * * *

UNITED STATES PATENT AND TRADEMARK OFFICE
CERTIFICATE OF CORRECTION

PATENT NO. : 5,133,412

DATED : July 28, 1992

INVENTOR(S) : Martin P. Coronodo

It is certified that error appears in the above-identified patent and that said Letters Patent is hereby corrected as shown below:

At column 3, line 36, insert --13-- between "string" and "is".
At column 3, line 37, delete "13" and insert --15--.
At column 3, line 39, insert --21.-- after the word "casing".
At column 3, line 41, insert --23.-- between "wireline" and "Alternately".
At colunm 3, line 43, insert --11-- between "device" and "of".
At column 4, line 19, insert --of-- between "11" and "the".
At column 4, line 31, insert --,-- between "11" and "upper".
At column 5, line 23, insert --33--between "pump" and "(of".
At column 5, line 30 insert --.-- between "33" and "internal".
At column 5, line 30, insert --53-- between "shoulder" and "is".
At column 5, line 50, insert --65-- between "piece" and "and lower".
At column 5, line 60, insert --61-- between "mandrel" and "includes".
At column 5, line 63, insert --51-- between "thread" and "of upper".
At column 5, line 66, insert --61-- between "mandrel" and "is also".
At column 6, line 21, insert --101-- between "end" and "of upper".
At column 6, line 61, insert --113-- between "groove" and "of lock".
At column 7, line 1, insert --63-- between "mandrel" and "in a fixed".
At column 7, line 24, insert --121,-- between "conduit" and "bypass";
at column 7, line 24, insert --111,-- between "port" and "and".
At column 7, lines 26 and 27 should not be a new paragraph.
At column 7, line 33, insert --121,-- between "conduit" and "when".
At column 7, line 37, insert --169.-- between "threads" and "lower".
At column 7, line 48, insert --11.-- between "device" and "lower".
At column 9, line 13, insert --of-- between "11" and "the".

UNITED STATES PATENT AND TRADEMARK OFFICE

CERTIFICATE OF CORRECTION

PATENT NO. : 5,133,412

DATED : July 28, 1992

INVENTOR(S) : Martin P. Coronodo

It is certified that error appears in the above-identified patent and that said Letters Patent is hereby corrected as shown below:

At column 9, line 18, insert --of-- between "11" and "the".
At column 9, line 54, insert --,-- between "181" and "serves".
At column 9, line 55, delete "11om" and insert --11 from--.
At column 9, line 56, delete "ar" and insert --are--.
At column 10, line 43, insert --13-- between "string" and "is".
At column 10, line 48, insert --of-- between "11" and "the".
At column 11, line 13, insert --of-- between "11" and "the".
At column 11, line 40, insert --in-- between "11" and "the".

Signed and Sealed this

Sixteenth Day of November, 1993

*Attest:*

Bruce Lehman

BRUCE LEHMAN

*Attesting Officer*

*Commissioner of Patents and Trademarks*